United States Patent [19]

Rohrer et al.

[11] Patent Number: 4,835,573

[45] Date of Patent: May 30, 1989

[54] MACHINE CONTROL SYSTEM UTILIZING PAPER PARAMETER MEASUREMENTS

[75] Inventors: Charles E. Rohrer, Boulder; Roger D. Shepherd, Nederland, both of Colo.

[73] Assignee: International Business Machines Corporation, Armonk, N.Y.

[21] Appl. No.: 188,018

[22] Filed: Apr. 29, 1988

[51] Int. Cl.[4] ..... G03G 15/00

[52] U.S. Cl. ..... 355/308; 355/77; 355/14 FU; 355/309; 355/285

[58] Field of Search ..... 355/14 R, 14 SH, 14 FU, 355/3 SH, 3 FU, 77, 14 CU; 271/262, 263

[56] References Cited

U.S. PATENT DOCUMENTS

| | | | |
|---|---|---|---|
| 3,955,811 | 5/1976 | Gibson | 271/9 |
| 4,295,733 | 10/1981 | Janssen et al. | 355/3 SH |
| 4,331,879 | 5/1982 | Gersl | 250/561 |
| 4,503,960 | 3/1985 | Koeleman et al. | 192/127 |
| 4,535,463 | 8/1985 | Ito et al. | 377/8 |
| 4,673,279 | 6/1987 | Brown | 355/14 SH |

*Primary Examiner*—R. L. Moses

*Attorney, Agent, or Firm*—Earl C. Hancock

[57] ABSTRACT

Data processing elements such as microcode count the number of cut sheets fed from a supply bin and also monitor the amount of bin travel. This yields data correlated to actual sheet thickness and weights useful for a variety of applications. For instance, the detected sheet data makes it is possible to logically optimize control of machine operating elements which are sensitive to supply sheet quality parameters.

13 Claims, 2 Drawing Sheets

MACHINE CONTROL SYSTEM UTILIZING PAPER PARAMETER MEASUREMENTS

FIELD OF THE INVENTION

This invention relates to methods and apparatus for developing and utilizing information from handling stacks of cut sheets in a supply bin. More particularly, the present invention relates to methods and means for measuring parameters associated with cut sheets stored in a bin and withdrawn therefrom in conjunction with operation of a machine and utilizing the measurement results to control the operation of the machine. The invention is especially useful for copiers, printers and the like which have supply drawers containing a stack of cut sheets and which have one or more machine elements that are adjustable to accommodate different sheet parameters or are operationally sensitive to such sheet parameters.

BACKGROUND OF THE INVENTION

Contemporary cut sheet handling systems have employed various sensors and processes for extracting information regarding cut sheets for monitoring machine performance and/or developing machine control responses. For instance, electrophotograhic machines sometimes sense sheet length at the supply tray output for setting inter-image erase machine controls. Sheet output sensing has also proven useful to provide jam recovery data and the like. Typically, xerographic copiers and printers include some form of paper height sensors which are often mechanically implemented.

Mechanical switches are widely used in cut sheet paper supply bins. For instance, they are used to signal that a stack of sheets in a supply bin is at an upper or lower limit. They are also used to indicate that the supply in the bin is exhausted, and this is sometimes supplemented with another switch positioned to detect that the stack is low enough that it needs replenishment by the operator.

U.S. Pat. No. 3,955,811 by David K. Gibson employs mechanical switches and a pedestal control system to maintain the stack of a standby bin in an intermediate position regardless of the amount of paper therein or its condition. U.S. Pat. No. 4,331,879 by Gersl includes a photocell assembly to monitor the top of the stack for height control.

Others have suggested using the results of stack height change sensing to warn the machine operator that an insufficient supply of cut sheets remain, or are available, in the supply bin to complete a selected machine operation. U.S. Pat. Nos. 4,503,960 by Koeleman et al and 4,535,463 by Ito et al are examples of such systems. The former bases its prediction on an assumed sheet thickness and sensed remaining stack height. Ito et al counts the number of copies run for a detected stack height change to calculate whether the remaining stack content is an adequate supply for the job.

As xerographic machines evolved, they have incorporated more and more data processing elements to control the machine functions. Further, such machines can operate more reliably if they can adjust certain operating parameters dynamically as a function of the quality and quantity of paper in the supply bin. Examples are adjustments of air pressure, picker roller force, fuser temperature and pressure operations in conjunction with staplers and stitchers and so forth. Unfortunately the known prior art does not disclose content of such machine elements based upon an accurate picture of the vital statistics and parameters of the paper in the bin. The present invention fills that void and in a manner well suited for advantageous implementation in microprocessor machine control environments.

DISCLOSURE OF THE INVENTION

The present invention is the process and means of controlling one or more elements of a machine where those elements are adjustable in response to an input signal to accommodate the quality of cut sheets which are handled in association with the element. Typically the cut sheets are extracted from a stack in a supply bin. First, a sheet quality factor is determined by dividing the amount the stack height changes in response to withdrawal therefrom of a predetermined number of sheets. A control signal is then provided to at least one of the machine elements in response to the sheet quality factor. By so doing, operation of the machine element is optimized based upon the sheet quality factor correlated to the sheet supply in the bin stack.

The determining process can include withdrawing a predetermined number of sheets from the supply bin, and measuring the change in the height of the stack of sheets in the bin in response to that withdrawing step. It is also possible for the determination to be based upon a sequence of placing a predetermined number of sheets in the supply bin and detecting the height of the stack of sheets in the supply bin containing that predetermined number of sheets.

Where the controlled machine includes an element associated with handling of the sheets which element is adjustable to accommodate the quality of the sheets thus handled, it is possible to apply the average cut sheet height factor so as to adjust the sheet quality sensitive element in response to that factor.

It is also possible to remeasure sheet quality or thickness factor as the machine functions to dynamically reperform the adjusting step.

In a electrophotographic machine, for instance, the present invention is suitable for controlling several elements. One such function is to adjust the pressure applied to the sheets by pinch rollers. Another is to adjust the temperature of an image fuser. Still another is to control a vacuum paper motivating means to employ a level of pressure suitable for moving the sheets contained in the bin.

Yet another implementation of this invention is to with respect to a stapler or stitcher device associated with the output of the machine. That is, operation coordinated with such means for securing sets of the sheets at the output of the machine can respond to sheet thickness determinations as to indicate that the stapler can accept the sheet sets, or by adjusting the stitcher to employ a suitable size staple if it is so adjustable. Where the set securing means has a predetermined capacity of sheets which it can accept, the controlling means can determine whether the number of sheets for delivery is compatible with that predetermined capacity.

If the set securing means is responsive to sheet thickness reflective output for adjusting the size of securing elements applied to secure each set of sheets together, the sheet thickness factor is useful to determine that setting.

The number of sheets extracted from the stack are counted, and the change in stack height, as a result of the extraction, are counted. The remaining number of sheets is then determinable and appropriate action decisions become available such as to accommodate different paper weights, and the like.

The present invention can employ a process for measuring the distance which a paper tray moves from a down limit switch to an up limit switch to ascertain the number of sheets in the paper bin. By utilization of appropriate data processing elements such as a microprocessor, the number of sheets is computed and, at the end of the first run or upon completion of a recirculating automatic document feed (RADF) cycle, information is developed or available on the number of originals and the number of copies requested. Presumably, a printer control processor would have the information available prior to a run as to the number of originals and the number of final copies. The microprocessor then compares the number of copy sheets in the paper bin with the number needed to complete the job and informs the operator whether additional paper is needed. The invention appears to have particular value in the context of high speed duplicating or printing equipment.

The process can provide projection information for a device that has a bin for receiving one or more cut sheets. It includes the steps of loading a predetermined number of cut sheets into the bin when it is empty, measuring the height of the stack in the bin formed by that predetermined number of cut sheets, and determining a factor representing the average height of a cut sheet by dividing the stack height by the predetermined number.

The process can further include the steps of remeasuring the height of the cut sheet stack in the bin, and dividing the remeasured height by said determined factor.

Another form of the present invention relates to use of data processing elements such as are potentially available in microcode to count the number of cut sheets fed from a supply bin and also to monitor the amount of bin travel. This yields data correlated to actual sheet thickness and weights thereby making several advantages possible.

The invention advantageously applies the results of a process for providing information relating to the supply of cut sheets stacked in a bin. It comprises the steps of withdrawing a predetermined number of sheets from the supply bin, followed by measuring the change in the height of the stack of sheets in the bin in response to the withdrawing step, and determining a sheet thickness factor by dividing the height change measurement by the predetermined number. This produces a sheet thickness factor which becomes available to aid in determining machine performance correlated to the quality of cut sheets in the supply bin.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENTS

Figure 1:
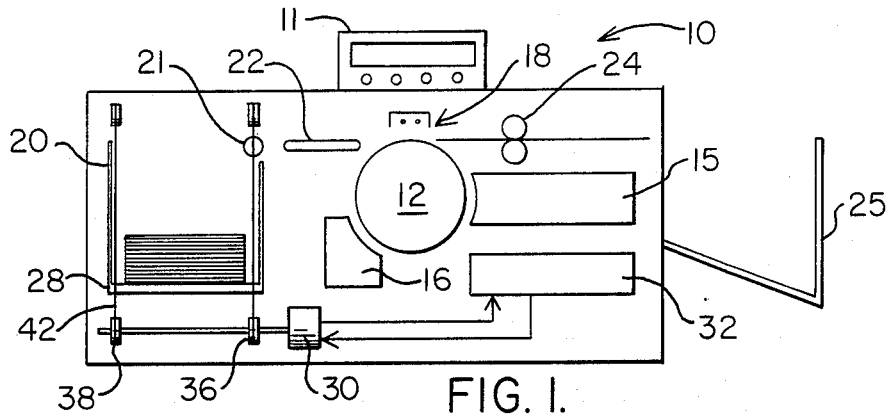
FIG. 1 is a partially schematic view of a typical xerographic machine environment for the present invention.

FIG. 1 is a somewhat schematic view of machine 10 illustrated as a typical xerographic copier/printer which can advantageously utilize the present invention. It includes a control tower 11 containing the buttons, switches and displays appropriate to allow the user to select the functions machine 10 is to perform. A drum 12 has a photoconductor surface which is exposed to a light image by an image source 15 which may take the form of an original document scanning mechanism, an electronically controlled light source such as one or more scanned lasers or LED arrays, or a combination thereof.

The image is formed on the photoconductive surface of drum 12 by selective discharge and rendered visible by toner transfer to the drum surface from developer 16. The toned image is ultimately presented at transfer station 18. Copy sheets contained in supply bin 20 are positioned for feeding seriatim into the machine by picker roller 21. The sheets are propelled along paper path 22 as by a vacuum transport into transfer station 18 where the toner defining the visible image is synchronously deposited on the sheet. They then pass through a fuser 24 and are deposited into an output unit such as a stacker or collator 25. Although not shown, the output module can also include a stapler for stapling complete document sets along with an accumulator to collect a complete set of sheets before presentation of that set to the stapler. The machine thus far described is conventional.

Bin 20 contains tray 28 which is vertically positioned by motor 30 in response to signals from control module 32. Tray 28 in high speed, large volume machines generally is lowered to allow reloading of cut sheet stacks such as 33. Subsequently control 32 actuates motor 30 to drive the tray upward until the top sheet of stack 33 is engaged by picker roller 21. Module 32 contains the electronics to direct operation of the machine in general including a data processor coupled to appropriate sensors.

Figure 2:
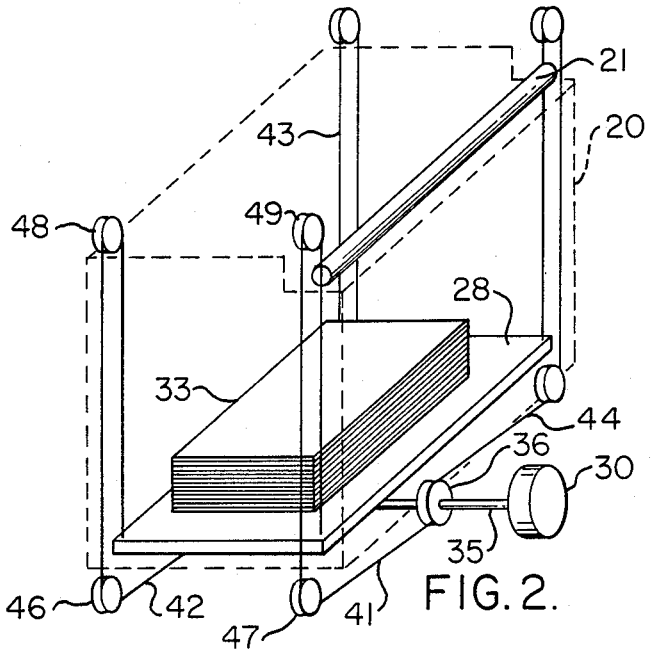
FIG. 2 is an isometric view of a supply tray and positioning drive motor.
Figure 3:
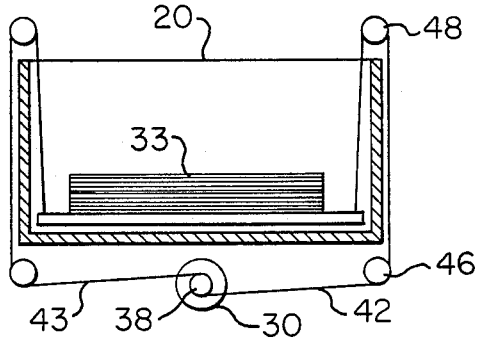
FIG. 3 is a side view illustrating the elevator cabling for the supply tray of the FIG. 1 and 2 bin.

FIGS. 2 and 3 illustrate a typical cable suspension elevator system for tray 28 of FIG. 1. Output shaft 35 of drive motor 30 is connected to rotate take-up spools 36 and 38. Rotation of motor 30 in a first direction causes cables 41–44 to wrap around spools 36 and 38 whereas rotation in the opposite direction causes cable 41–44 to unwind from the spools. Cables 41–44 pass over appropriately positioned pulleys (eg: pulleys 46–48) and are attached to tray 28 at their other ends thereby pulling tray 28 upwardly in response to the first direction of motor 30 rotation while lowering tray 28 in response to opposite rotational direction. There are a variety of other means which are functionally acceptable for elevating tray 28 such as by screw thread columns, strap systems, lever arms, etc.

There are several means available to inform controls 32 of the physical position of tray 28. If motor 30 is a stepper motor, its position is determinable by the number of actuator pulses introduced thereto along with the direction of actuation. For DC motors, the time and magnitude or duty cycle of actuation can correlate to motor position. Mechanical or photocell sensors directly associated with tray 28 can also provide information about the tray location and its movement.

The present invention relates to a process of monitoring the copier/printer 10 paper supply 33.

The information gained by this monitoring is used for job planning by the machine or the operator to minimize job interruptions and for improving machine operation.

In one arrangement in accordance with this invention, motor 30 is tachometer equipped and moves the paper tray 28 in a paper supply drawer 20. The tray 28 is lowered to a down limit switch for loading. After loading, the tray 28 is raised to an up-limit switch where the top sheet of the stack 33 is engaged by picker roller 21. The tachometer output from down to up is an accurate measurement of the paper stack 33 thickness. Machine logic can then convert thickness to number of sheets, using operator keyed input or some assumption of a paper standard as the basis. As sheets are used, they are deducted. If desired, it is possible to display the number remaining.

If machine 10 contains a recirculating automatic document feed (RADF), the control logic can automatically provide the original count at the end of the first cycle. Typically, the electronic controls associated with a printer function will have the various count information before a print run is started and can make it available as needed.

Appropriate logic could also calibrate for paper thickness if a known number of sheets were added to an empty tray, then divided by the subsequent tachometer count to elevate the tray to the up-stop.

Reviewing the above, the elevator mechanism in the copy paper supply bin 20 is lowered to a down limit switch for loading a stack 33 on tray 28. Upon raising tray 28 to an up limit switch, the height of the paper stack is ascertained. Specifically, a tachometer on the elevator motor 30 provides stack height information to machine logic. The processor in control module 32 then converts stack height to the number of sheets in the stack 33 by assuming a standard paper weight (ie: 20 lbs.) in the stack. This makes it possible to display the number of sheets available if desired. Obviously this also makes it possible to display an indication of the need to put more copy paper in the bin 20 to complete a requested job.

Another way of calculating sheet thickness data for material in the copy paper bin 20 is by counting tachometer pulses, for example, for the elevator to raise the stack 33 to the up limit switch. Feeding sheets off the stack is then commenced with counting of the number of sheets as they are thus fed. After counting to at least a predetermined number of sheets, (for example, 10, 20, etc.), the height of the paper stack 33 is again calculated. By dividing the difference in stack height by the number of sheets fed out of the bin, the thickness of a single sheet is accurately determined.

Alternatively, after counting to at least a predetermined number of tachometer pulses, i.e., to at least a predetermined stack height, divide the stack height by the number of sheets fed out of the bin 20. This accurately provides the thickness of a single sheet and in a manner not dependent upon an assumption about the quality and quantity of the paper in the paper bin 20.

This information is useful in one or more of a variety of manners. The number of sheets in the stack height can vary a significant amount if 16 or 24 lb. paper is present instead of 20 lb. especially if the bin size is large as in a printer or high-speed copier. Note that the invention is of particular value in a printer where the number of sheets to perform a job is a known quantity. In a copier, a first cycle of an RADF can provide the number of originals for copying.

Through accurate knowledge of the number of sheets in a specific stack height, the maximum number of sheets capable of stapling at a finisher is also accurately ascertainable In this manner, the need to design the stapler based upon worst case conditions of maximum paper weight, paper swell, etc. is alleviated while retaining or improving stapler reliability. The benefit of this use is that it can lower base manufacturing cost while improving both efficiency and reliability. For stitchers which select the size of staples or the like that are employed to secure a set of output sheets together is another potential recipient of control signals derived from the sheet thickness determination.

Another advantage from extracting the sheet data is that it is then possible to optimize vacuum pressures by adjustment to sheet thickness (weight) for all vacuum components of a paper moving system, e.g., vacuum pick-off; vacuum transport; vacuum detach; and full speed duplex vacuum rolls. Such an adjustment can have significant reliability benefits. For machines using staplers, it is possible to predict whether the stapler can accept a set of the given count with the determined sheet parameter data. That is, staplers may accept X sheets of 24 lb. paper, but X+Y sheets of 18 lb. paper. If the stapler is automatically adjustable, the controls can use the sheet data to set those adjustments. It is further possible to adjust pinch roll normal force to paper thickness with the possibility of significant reliability improvement.

The implementation of this invention to provide the desired control information involves advantageous employment of various contemporary elements. A linear position encoder can provide an output signal indicative of the position of tray 28 in the copy paper bin 20. Many equipments are suitable for use in conjunction with this invention. Examples include a digital tachometer on the elevator motor 30 as suggested above; a stepper motor for motor 30 to raise and lower tray 28 in bin 20; timing the operation of the elevator motor 30 and converting that time to a corresponding digital count in the processor within electronic module 32; providing pulse generating or analog mechanisms along the bin tray 28 path for activation as tray 28 elevates or descends, as is possible with optical, inductive, capacitive, or resistive sensors. The preferred implementation at this time is either the digital tachometer or the stepper motor.

Many functions are controllable through use of microcode and appropriate cooperative data processing equipments. Microcode can determine position information to calculate sheet thickness and derive sheet weight, if desired. Microcode can also control the stapler and/or the display in accordance with the control information. It can likewise selectively enable actuators to control vacuum pressure as well as to control nip force, all in response to the control information.

This invention relates to method and means for automatically determining the thickness and weight of individual sheets of paper or other image receiving material in a paper bin; a method of controlling the stapler of a copier or printer in accordance with the thickness of image receiving sheets; a method of controlling a vacuum system in accordance with the sheet weight; and a method of controlling pinch roll nip force in accordance with the thickness of the copy paper sheets.

Figure 4:
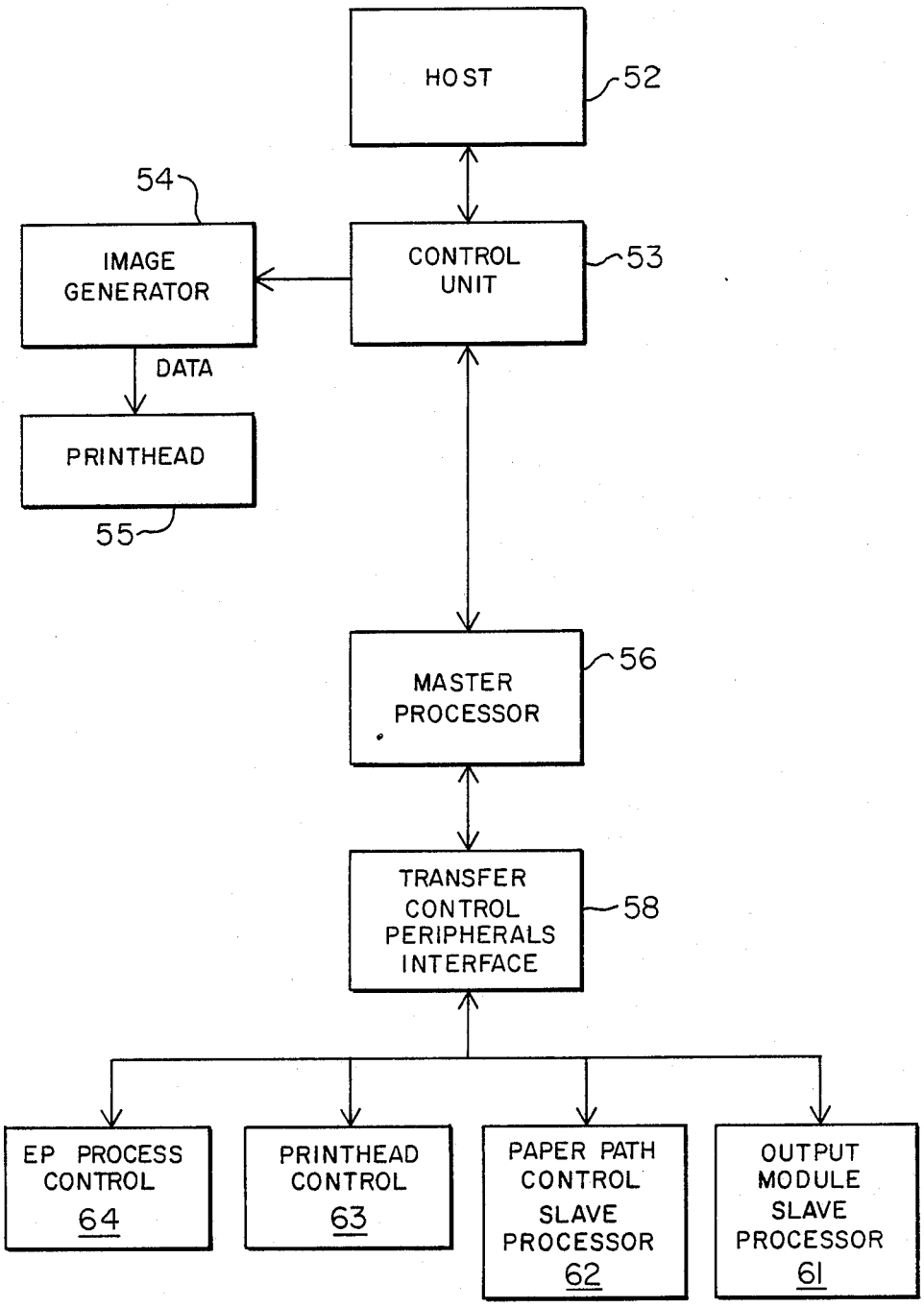
FIG. 4 is a block diagram of the data processing components associated with one implementation of the present invention.

The FIG. 4 block diagram shows major electronic elements associated with running a typical electrophotographic printer machine and developing the control information described above. The host 52 originates signals that define the printing job the machine is to perform. The control unit 53 responds to direct image generating data to image generator 54 which presents as its output data to the printhead 55 implemented as a laser or LED array, for example. The other control intelligence is passed on to the master processor 56 which then directs it to the slave processors 61–64 (all of which could be Intel 8051 microprocessors, for instance) via transfer control peripheral interface 58. The electrophotographic process (EP) control 64 handles much of the machine housekeeping while processor 63 directs the head synchronization as with a rotating mirror modulator for a laser. The output module control 61 handles the stapler or stitcher if it is present as well as stacking, output bin selecting and the like. Processor 61 is the beneficiary of determination of the acceptability of set sizes by the stapler or adjustment signals for a stitcher as a result of calculations performed in processor 56.

The machine variables that are sensitive to supply sheet quality are controlled by master processor 56 (an Intel 80186, for instance) while paper control slave processor 62 performs much of the dynamic adjustments associated with paper quality. That is, the actual signals to control roller force pressure, paper transport vacuum pressure, or fuser temperature can originate from processor 62.

The following are examples of three Software Architecture Design Language (SADL) diagrams which designers and programmers can implement in microcode or software for control of relevant data processing equipments. The first relates to bin travel measurement, the second to the sheet factor calculation and the third to selected actions as a result of the other modules with particular emphasis on use of calculated data to control machine operations. Note that FIFO refers to the sheet handling associated with operation of a conventional duplex tray when the machine is configured with such a device. Thus, these modules presume the machine with which they are associated has copier functions available including duplex capability and a recirculating automatic document feed (RADF).

```
BEGINSEGMENT (MEASURE)
1.  TEXT
THIS SEGMENT IS PART OF THE PAPER PATH SLAVE
PROGRAM.  AS THE PAPER BIN MOTOR RUNS, THE
DISTANCE IT TRAVELS IS MEASURED.  THE MANNER OF
MEASUREMENT MAY BE :
    - TIME HOW LONG  THE MOTOR RAN
    - COUNT STEPS IF A STEPPER MOTOR IS USED
    - COUNT TACHS FROM A TACHOMETER DEVICE ON THE
        MOTOR OR IN THE BIN
WHEN THE MOTOR QUITS, THE MEASURED TRAVEL DISTANCE
IS PASSED BACK TO THE MASTER PROCESSOR.
1.  ENDTEXT;
1.  IF BIN MOTOR IS RUNNING
1.  THEN
2.  . MEASURE DISTANCE TRAVELED
        BY COUNTING TIME OR STEPS
        OR TACHS;
1.  ELSE
2.  . IF BIN MOTOR JUST QUIT
        RUNNING
2.  . THEN
3.  . . SEND MEASUREMENT TO THE
```

```
                MASTER PROCESSOR;
        2.   . ENDIF;
        1.   ENDIF;

         ENDSEGMENT (MEASURE);

         BEGINSEGMENT (CALCULATE)
        1.   TEXT
```

THIS SEGMENT IS PART OF THE MASTER PROCESSOR PROGRAM. IT RECEIVES THE BIN TRAVEL MEASUREMENT FROM THE PAPER PATH SLAVE. SEVERAL VARIABLES ARE THEN CALCULATED FOR LATER USE. THESE VARIABLES ARE :

- BIN HEIGHT = A RUNNING SUM OF BIN TRAVEL MEASUREMENTS
- HEIGHT FACTOR = A FACTOR NEEDED TO CHANGE THE BIN TRAVEL MEASUREMENT TO ACTUAL BIN TRAVEL DISTANCE. BIN HEIGHT MAY AFFECT THE RELATION BETWEEN THE MEASUREMENT AND THE ACTUAL TRAVEL DISTANCE. THE BIN HEIGHT VARIABLE IS USED TO DETERMINE THE HEIGHT FACTOR VARIABLE FROM AN EQUATION OR FROM A TABLE.
- SHEET THICKNESS = CALCULATED FROM THE HEIGHT FACTOR, THE BIN TRAVEL MEASUREMENT, AND THE NUMBER OF SHEETS PICKED DURING THE MEASUREMENT INTERVAL (COUNTED BY THE MASTER PROCESSOR)
- REMAINING SHEETS = CALCULATED FROM BIN HEIGHT AND SHEET THICKNESS
- ACCUMULATOR CAPACITY = CALCULATED FROM THE ACCUMULATOR SIZE CONSTANT AND SHEET THICKNESS VARIABLE
- FIFO CAPACITY = CALCULATED FROM THE FIFO SIZE

CONSTANT AND THE SHEET
THICKNESS VARIABLE

- EXIT TRAY CAPACITY = CALCULATED FROM THE EXIT TRAY SIZE CONSTANT AND SHEET THICKNESS VARIABLE
- STACK TRAY CAPACITY = CALCULATED FROM THE STACK TRAY SIZE CONSTANT AND SHEET THICKNESS VARIABLE
- ROLL FORCE = THE FORCE USED AT PINCH ROLLS WHICH MOVE SHEETS THROUGH THE MACHINE IS DETERMINED FROM AN EQUATION OR TABLE USING THE SHEET THICKNESS VARIABLE
- VACUUM PRESSURE = THE VACUUM PRESSURE USED AT MECHANISMS WHICH MOVE SHEETS THROUGH THE MACHINE IS DETERMINED FROM AN EQUATION OR TABLE USING THE SHEET THICKNESS VARIABLE
- FUSER TEMPERATURE = THE TEMPERATURE AT WHICH THE FUSER WILL BE KEPT IS DETERMINED FROM AN EQUATION OR TABLE USING THE SHEET THICKNESS VARIABLE

1. ENDTEXT;
1. RECEIVE BIN TRAVEL MEASUREMENT FROM PAPER PATH SLAVE;
1. CALCULATE BIN HEIGHT = BIN HEIGHT + BIN TRAVEL MEASUREMENT;
1. CALCULATE HEIGHT FACTOR = F (BIN HEIGHT);
1. CALCULATE SHEET THICKNESS = HEIGHT FACTOR * BIN TRAVEL MEASUREMENT / SHEETS PICKED;
1. CALCULATE SHEET CAPACITY = (BIN SIZE - BIN HEIGHT) / SHEET THICKNESS;

```
1. CALCULATE ACCUMULATOR CAPACITY =
     ACCUMULATOR SIZE / SHEET
     THICKNESS;
1. CALCULATE FIFO CAPACITY = FIFO
   SIZE / SHEET THICKNESS;
1. CALCULATE EXIT TRAY CAPACITY =
     EXIT TRAY SIZE / SHEET
     THICKNESS;
1. CALCULATE STACK TRAY CAPACITY =
     STACK TRAY SIZE / SHEET
     THICKNESS;
1. CALCULATE FUSER TEMPERATURE =
     F (SHEET THICKNESS);
1. CALCULATE VACUUM PRESSURE =
     F (SHEET THICKNESS);
1. CALCULATE ROLL FORCE =
     F (SHEET THICKNESS);

     ENDSEGMENT (CALCULATE);

  BEGINSEGMENT (ACT)
1.  TEXT
```

THIS SEGMENT IS PART OF THE MASTER PROCESSOR PROGRAM. IT ACTS UPON THE CAPACITY VARIABLES CALCULATED IN THE LAST SEGMENT.

- REMAINING SHEET CAPACITY WILL BE DISPLAYED ON THE CRT.
- WHEN ACCUMULATOR CAPACITY IS REACHED, THE SET WILL BE STAPLED AND EJECTED.
- USE THE CALCULATED ROLL FORCE TO CONTROL PINCH ROLL MECHANISMS AS SHEETS ARE BEING MOVED.
- USE THE CALCULATED VACUUM PRESSURE TO CONTROL VACUUM MECHANISMS AS SHEETS ARE BEING MOVED.
- USE THE CALCULATED FUSER TEMPERATURE TO CONTROL ACTUAL FUSER TEMPERATURE AS SHEETS ARE BEING FUSED.

- WHEN FIFO CAPACITY IS REACHED, ORIGINALS WILL BE RECIRCULATED AND DUPLEX SIDE2 WILL START.
- WHEN EXIT TRAY CAPACITY IS REACHED, COPYING WILL PAUSE AND THE 'REMOVE COPIES' MESSAGE WILL BE DISPLAYED ON THE CRT.
- WHEN STACK TRAY CAPACITY IS REACHED, COPYING WILL PAUSE AND THE 'REMOVE COPIES' MESSAGE WILL BE DISPLAYED ON THE CRT.

```
1. ENDTEXT;
1. DISPLAY REMAINING SHEET CAPACITY
     ON THE CRT;

1. SEND ROLL FORCE AND VACUUM
     PRESSURE VARIABLES TO PAPER PATH
     SLAVE WHERE THE PINCH ROLL AND
     VACUUM MECHANISMS ARE CONTROLLED
     TO MOVE SHEETS;
1. SEND FUSER TEMPERATURE VARIABLE TO
     PAPER PATH SLAVE WHERE THE FUSER
     MECHANISM IS CONTROLLED TO FUSE
     SHEETS; "1.  IF SHEET WENT TO THE"
ACCUMULATOR
1. THEN
2. . IF SET IS COMPLETE
3. . . CLEAR SET COUNTER;
3. . . STAPLE IF STAPLING IS
         SELECTED;
3. . . EJECT THE COMPLETED SET;
2. . ELSE
3. . . INCREMENT SET COUNTER,
3. . . IF SET COUNTER >= ACCUMULATOR
         CAPACITY
3. . . THEN
4. . . . CLEAR SET COUNTER;
4. . . . STAPLE IF STAPLING IS
         SELECTED;
4. . . . EJECT THE PARTIAL SET;
3. . . ENDIF;
```

```
2. . ENDIF;
1. ELSE
2. . IF SHEET WENT TO THE FIFO TRAY
2. . THEN
3. . . INCREMENT FIFO COUNTER;
3. . . IF FIFO COUNTER >= FIFO
        CAPACITY
3. . . THEN
4. . . . STOP COPYING DUPLEX SIDE-1;
4. . . . RECIRCULATE ORIGINALS BACK
          TO BEGINNING IN RADF;
4. . . . START COPYING DUPLEX SIDE-2;
3. . . ENDIF;
2. . ELSE
3. . . IF SHEET WENT TO EXIT TRAY
3. . . THEN
4. . . . INCREMENT EXIT COUNTER;
4. . . . IF EXIT COUNTER >= EXIT
          CAPACITY
4. . . . THEN
5. . . . . PAUSE COPYING;
5. . . . . DISPLAY 'REMOVE COPIES
            FROM EXIT TRAY' MESSAGE
            ON CRT;
4. . . . ENDIF;
3. . . ENDIF;
2. . ENDIF;
1. ENDIF
1. IF SET WAS EJECTED INTO STACK
     TRAY
1. THEN
2. . ADD SET COUNTER TO STACK
       COUNTER;
2. . CLEAR SET COUNTER;
2. . IF STACK COUNTER >= STACK TRAY
       CAPACITY
2. . THEN
3. . . PAUSE COPYING;
```

```
3. . . DISPLAY 'REMOVE COPIES FROM
          STACK TRAY' MESSAGE ON CRT;
2. . ENDIF;
1. ENDIF;

ENDSEGMENT (ACT) ;
```

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. The process of controlling one or more elements of a machine where said elements are adjustable in response to an input signal to accommodate the quality of cut sheets which are handled in association with the element where the cut sheets are extracted from a stack in a supply bin comprising steps of:

determining a sheet quality factor by dividing the amount the stack height changes in response to withdrawal therefrom of a predetermined number of sheets, and providing a control signal to at least one said machine element in response to said sheet quality factor, whereby operation of the machine element is optimized based upon said sheet quality factor correlated to the sheet supply in the bin stack.

2. The process in accordance with claim 1 wherein said determining step includes the steps of withdrawing a predetermined number of sheets from the supply bin, and measuring the change in the height of the stack of sheets in the bin in response to said withdrawing step.

3. The process in accordance with claim 1 wherein said determining step includes the steps of:

placing a predetermined number of sheets in the supply bin, and detecting the height of the stack of sheets in the supply bin containing said predetermined number of sheets.

4. A process for providing projection information for a device having a bin for receiving one or more cut sheets and at least one element associated with handling of the sheets which element is adjustable to accommodate the quality of the sheets thus handled comprising the steps of:

loading a predetermined number of cut sheets into the bin when it is empty, measuring the height of the stack in the bin formed by said predetermined number of cut sheets, determining a factor representing the average height of a cut sheet by dividing the stack height by the predetermined number, and adjusting the sheet quality sensitive element in response to said factor from said determining step.

5. The process in accordance with claim 4 which includes the further steps of counting the number of sheets removed from the stack for a given period of time, remeasuring the height of the cut sheet stack in the bin to determine its height change, dividing the remeasured height change by the results of the counting step to produce a new determined factor, and reperforming said adjusting step.

6. The process in accordance with claim 4 wherein said adjusting step includes the steps of adjusting the pressure applied to the sheets by pinch rollers, and adjusting the temperature of an image fuser.

7. In a device having a supply bin containing a stack of sheet media which stack is urged in a first direction towards a feeder station where the sheets are extracted from the stack and wherein the device includes at least one element associated with handling of the sheets by the machine but which element is responsive to control signal for adjusting its sheet handling response, apparatus for optimizing operation of the device comprising means sensing the height of the stack in said first direction for producing an output signal corresponding to said height, means producing an output indicative of the count of the number of sheets extracted from the stack over a predetermined time period, means receiving said count producing means output along with changes in said sensing means output signal corresponding to the change in stack height during said predetermined time period for generating an output reflective of the sheet media characteristics, and means responsive to said sheet media characteristic reflective output for introducing a control signal to the adjustable element.

whereby the device operating parameters are optimized to handle the sheets actually in the supply bin stack.

8. Apparatus in accordance with claim 7 wherein the adjustable element is pinch rollers for motivating the sheets through the device, said control signal introduced thereto causing said rollers to assert pressure upon said sheets in conformance to the quality of said sheets.

9. Apparatus in accordance with claim 7 wherein the adjustable element is a heated fuser, said control signal introduced thereto causing said fuser to apply a temperature correlated to the quality of the sheets from the bin.

10. Apparatus in accordance with claim 7 wherein the adjustable element is a vacuum paper motivating means, said control signal introduced thereto causing said vacuum motivating means to employ a level of pressure suitable for the moving the sheets contained in the bin.

11. In a device having a supply bin containing a stack of sheet media which stack is urged in a first direction towards a feeder station where the sheets are extracted from the stack and wherein the device includes a means for securing sets of the sheets at the output of the machine, apparatus for optimizing operation of the device comprising means sensing the height of the stack in said first direction for producing an output signal corresponding to said height, means producing an output indicative of the count of the number of sheets extracted from the stack over a predetermined time period, means receiving said count producing means output along with changes in said sensing means output signal corresponding to the change in stack height during said predetermined time period for generating an output reflective of the sheet media thickness, and means responsive to said sheet media thickness reflective output for controlling operation of the device in conjunction with the set securing means, whereby the device operating parameters are optimized to handle the sheets actually in the supply bin stack.

12. Apparatus in accordance with claim 11 wherein said set securing means has a predetermined capacity of sheets which it can accept, said controlling means including means for determining whether the number of sheets for delivery is compatible with said predetermined capacity.

13. Apparatus in accordance with claim 11 wherein said set securing means is responsive to said sheet thickness reflective output for adjusting the size of securing elements applied to secure each set of sheets together.

* * * * *